US009440335B2

(12) United States Patent
Correia

(10) Patent No.: US 9,440,335 B2
(45) Date of Patent: Sep. 13, 2016

(54) BRIDGE ADJUSTMENT TOOL

(71) Applicant: Eric Michael Correia, Burleson, TX (US)

(72) Inventor: Eric Michael Correia, Burleson, TX (US)

( * ) Notice: Subject to any disclaimer, the term of this patent is extended or adjusted under 35 U.S.C. 154(b) by 400 days.

(21) Appl. No.: 14/083,262

(22) Filed: Nov. 18, 2013

(65) Prior Publication Data

US 2014/0137704 A1 May 22, 2014

Related U.S. Application Data

(60) Provisional application No. 61/727,238, filed on Nov. 16, 2012.

(51) Int. Cl.
*B25B 13/48* (2006.01)
*B25B 13/06* (2006.01)

(52) U.S. Cl.
CPC ..... *B25B 13/06* (2013.01); *B25B 13/48* (2013.01)

(58) Field of Classification Search
CPC ... B25B 13/06; B25B 13/48; B25B 23/0078; B25B 23/0085; B25B 27/0035; B25B 13/488
USPC ..... 81/9.24, 55
See application file for complete search history.

(56) References Cited

U.S. PATENT DOCUMENTS 1,435,544 A * 11/1922 Miller ..... B25B 13/488 81/57.32
1,485,062 A * 2/1924 Baldus ..... B25B 13/488 220/DIG. 26
1,509,258 A * 9/1924 Reiser ..... B25B 13/488 81/124.4
1,824,300 A * 9/1931 Rowland ..... B25B 13/48 81/56
1,914,827 A * 6/1933 Hammerich ..... B25B 13/488 81/125.1
2,196,929 A * 4/1940 Lizakowski ..... B25B 13/08 81/13
2,601,796 A * 7/1952 Palesh, Jr. ..... B25B 13/48 7/100
2,666,350 A * 1/1954 Hackett ..... B25B 13/48 81/9.24
2,952,178 A * 9/1960 Buchheim ..... B25B 13/488 81/13
3,731,559 A * 5/1973 Krupke ..... B25B 13/48 81/13
5,775,183 A * 7/1998 Tavianini ..... B25B 13/488 81/13
6,634,260 B1 * 10/2003 Smith ..... B25B 13/48 81/462
7,104,161 B2 * 9/2006 De Waal ..... B25B 13/48 123/90.52
7,261,017 B2 * 8/2007 Jensen ..... B25B 23/0078 81/124.5
8,353,229 B1 * 1/2013 Muhareb ..... B25B 13/06 81/55
2012/0131808 A1 * 5/2012 Spencer ..... F01L 1/20 33/611

* cited by examiner

*Primary Examiner* — David B Thomas
(74) *Attorney, Agent, or Firm* — Ross Barnes LLP; Monty L. Ross; Robin L. Barnes

(57) ABSTRACT

A valve bridge adjustment tool has top and bottom sections disposed in fixed relation to each other and preferably made of steel or another durable metal alloy. The bottom section has a U-shaped recess with an open end that is releasably engageable with a knuckle of a valve bridge to stabilize the bridge whenever a jam nut is either loosened or tightened. The top section comprises a hexagonal outer wall and a substantially cylindrical bore adapted to receive the jam nut upwardly through the U-shaped recess into the bottom portion of the bore, with sufficient remaining clearance around the jam nut to permit insertion of a pass-through socket into the top of the bore and into engagement with the jam nut. The subject invention is especially useful with many internal combustion engines having four valves per cylinder.

7 Claims, 7 Drawing Sheets

BRIDGE ADJUSTMENT TOOL

CROSS-REFERENCE TO RELATED APPLICATION

This application claims the benefit under 35 U.S.C. §119(e) of U.S. provisional Application No. 61/727,238, filed Nov. 16, 2012.

BACKGROUND OF THE INVENTION

1. Field of the Invention

This invention generally relates to a tool useful for stabilizing a valve bridge while loosening or tightening a jam nut when adjusting valves of engines, and especially those engines having four valves per cylinder.

2. Description of Related Art

In the past, valve adjustments for four-valve engines have been difficult to manage because of the fact that one hand of a user is needed to hold a wrench to manipulate the jam nut disposed on the bridge beneath a rocker arm while the other hand is needed handle a screwdriver to turn the adjustment screw. Also, where the jam nut is difficult to loosen, excessive torque may be applied to the bridge, often producing misalignment or bending of the valve pushrods. Some engine technicians have attempted to use a second wrench disposed beneath the wrench controlling the jam nut to engage the knuckle of the bridge and reduce the likelihood of damage while turning the jam nut. In that case, however both wrenches must be manipulated by one hand of the user, and it is difficult to maintain the proper wrench alignment and apply oppositely directed force to both wrenches while simultaneously turning the adjustment screw with the other hand. A tool is therefore needed that will facilitate valve adjustments, especially in engines having four valves per cylinder.

SUMMARY OF THE INVENTION

According to one embodiment of the invention, a valve bridge adjustment tool, which can also be termed an adapter but is referred to below as the "tool," is disclosed. The tool desirably comprises unitarily formed or interconnected top and bottom sections disposed in fixed relation to each other and preferably made of steel or another similarly durable metal alloy. The bottom section of the tool desirably has a U-shaped recess with an open end that can be lowered onto and is releasably engageable with a knuckle of a valve bridge so that the tool can stabilize the bridge whenever a jam nut connecting a valve push rod to the bridge is either loosened to adjust a valve or tightened following the valve adjustment. The top section of the tool desirably comprises a hexagonal outer wall and a substantially cylindrical bore. The bore is preferably sized to permit insertion of a conventional pass-through socket into the top of the bore and is positioned relative to the U-shaped recess of the bottom section to receive the jam nut upwardly through the U-shaped recess into the bottom portion of the bore, and into engagement with the jam nut. In one embodiment of the invention, the side walls of the U-shaped recess in the bottom section of the tool partially occlude a portion of the bore through the top section to assist in positioning or seating the open end of the socket in relation to the U-shaped recess of the bottom section, the jam nut, and the top surface of the bridge.

The tool of the invention is preferably assembled together with the pass-through socket, a closed or partially open box-end wrench engaging the hexagonal top section of the tool, and a pass-through ratchet wrench releasably engaging the top of the pass-through socket prior to installation of the tool onto the bridge. During use of the invention, the assembly comprising the tool, the socket and the two wrenches is desirably lowered or otherwise moved into position so that the U-shaped recess on the underside of the bottom section is urged into sliding engagement with a bridge knuckle and so that the jam nut disposed above the bridge knuckle extends upwardly through the U-shaped recess and into the bottom portion of the substantially cylindrical bore of the top section and into engagement with the open end of the pass-through socket. When installed in this manner, the subject tool is desirably disposed in a stable position relative to the bridge and the jam nut, with the laterally extending handle of the box-end wrench being available for grasping by the user when torque is applied to the jam nut by means of the ratchet wrench. A significant advantage of the present invention is that the height of the top section is sufficient relative to the thickness of the box-end wrench head that the user can remove his or her hand from the wrench once positioned over the tool without having either the wrench or the tool become disengaged from the bridge. While the assembly comprising the tool is disposed on the bridge, a screwdriver can be inserted through the ratchet wrench and the pass-through socket to adjust the stud to which the jam nut is attached.

The user can install the assembly comprising the tool onto the bridge and then manipulate the ratchet portion of the socket wrench while exerting stabilizing pressure on the box-end wrench engaging the subject tool while exerting oppositely directed pressure to the handle of the box-end wrench to loosen the jam nut, thereby permitting screwdriver adjustment of the valve pushrod stud relative to the bridge through the socket wrench and socket. Following adjustment of the stud, the direction selector lever on the socket wrench can be moved to facilitate tightening of the jam nut relative to the bridge while holding the stud in place with a screwdriver. Once the jam nut is tightened, the tool, box-end wrench, socket and socket wrench can all be removed from the valve bridge for use in adjusting another valve.

BRIEF DESCRIPTION OF THE DRAWINGS

The apparatus of the invention is further described and explained in relation to the following drawings wherein.

DESCRIPTION OF ILLUSTRATIVE PREFERRED EMBODIMENTS

Figure 1:
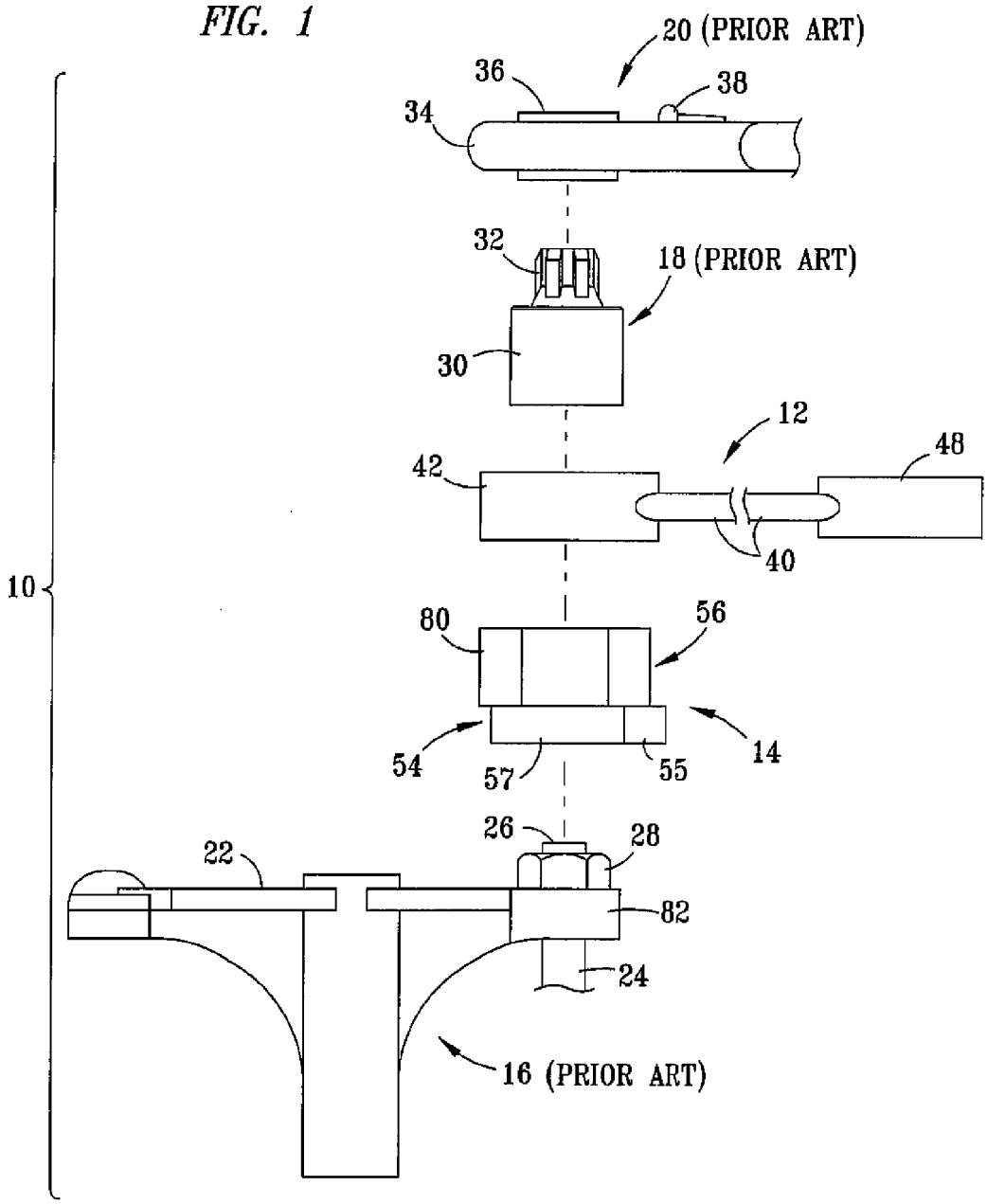
FIG. 1 is an exploded front elevation view of one embodiment of a valve bridge adjustment tool of the invention coaxially aligned in relation to a valve bridge (prior art), wrenches (prior art) and a socket (prior art) with which it can be used.
Figure 5:
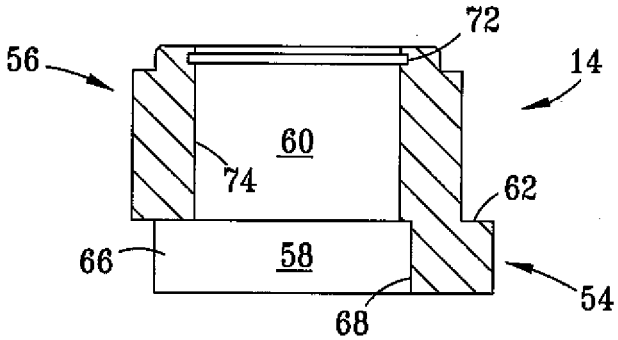
FIG. 5 is a cross-sectional front elevation view taken along line 5-5 of FIG. 4.

FIG. 1 discloses a simplified exploded assembly 10 including valve bridge adjustment tool 14 of the invention (hereafter "tool 14" for the sake of brevity) disposed in operational alignment with but separated vertically apart from conventional valve bridge assembly 16 (prior art), conventional box-end wrench 12 (prior art), conventional pass-through socket 18 (prior art) and conventional pass-through ratchet wrench 20 (prior art). The conventional parts are included in this disclosure to facilitate description of how the invention is made and used, but do not constitute part of this embodiment of the invention. Tool 14 desirably further comprises bottom section 54 and top section 56. Top section 56 and bottom section 54 are preferably manufactured as an integral or unitary structure or are otherwise interconnected in fixed relation to each other in this embodiment of invention. Top section 56 desirably has a hexagonal outer wall 30 to facilitate engagement with end 40 of conventional box-end wrench 12. Bottom section 54 desirably comprises an arcuate rear portion and an upwardly facing wrench support surface 62 (FIG. 5). A preferred material for use in making tool 10 is steel or another durable metal alloy.

As depicted in simplified form for illustrative purposes in FIG. 1, valve bridge assembly 16 (conventional) further comprises bridge top surface 22, knuckle 82, valve pushrod 24, jam nut 28 and adjustment screw 26. Box-end wrench 12 (conventional) further comprises opposed box-end sections 42, 48 joined in fixed relation by intermediate handle 40. If desired, wrench end 42 can also have a partially open configuration if desired. According to one embodiment of the invention, box-end 42 is desirably sized to operably engage hexagonal outer surface 80 of top section 56 of tool 14 and box-end 48 is desirably sized to engage the bolts (typically 11/16 inch) securing the valve cover (not shown) to the engine with which tool 14 is intended to be used. Pass-through socket 18 desirably comprises bottom portion 30 and top portion 32. Bottom portion 30 comprises a downwardly facing open end (as depicted in FIG. 1) that is insertable into top section 56 and engageable with jam nut 28. Top portion 32 comprises a male projection engageable with female receptacle 36 of end 34 of ratchet wrench 20 (conventional) having a directional selector lever 38.

Figure 2:
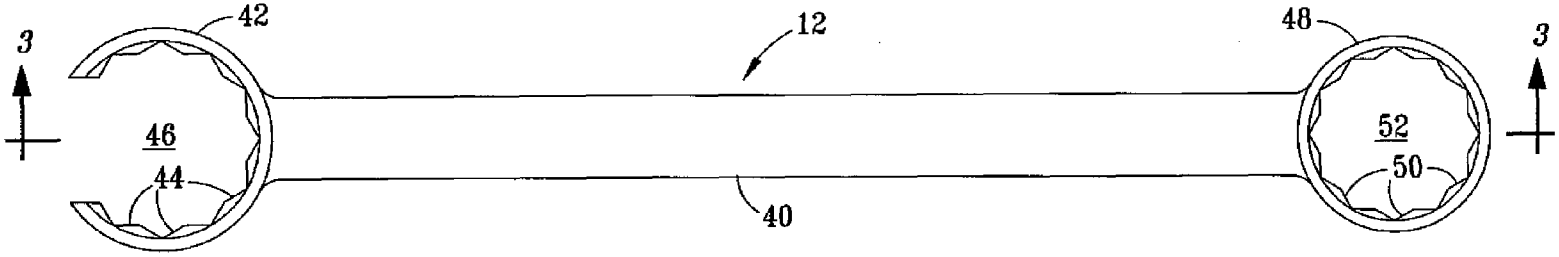
FIG. 2 (PRIOR ART)
FIG. 2 is a top plan view of a box-end wrench suitable for use with the valve bridge adjustment tool of FIG. 1.
Figure 3:
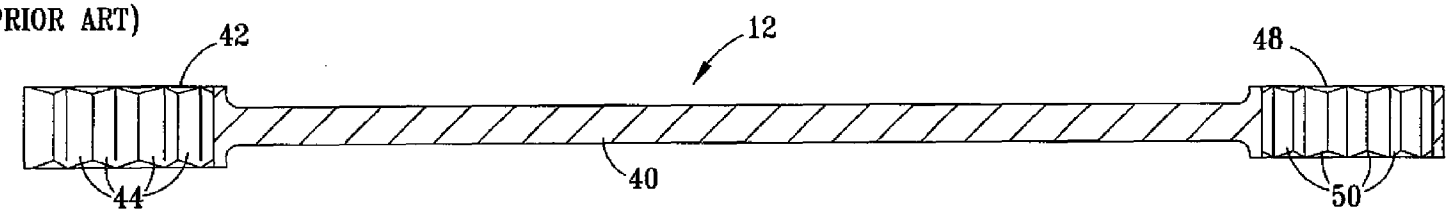
FIG. 3 (PRIOR ART)
FIG. 3 is a cross-sectional front elevation view taken along line 3-3 of FIG. 2.

Referring to FIGS. 2 and 3, a conventional box-end wrench 12 is disclosed that comprises larger end 42 and smaller end 48 separated by handle 40. Large end 42 has a plurality of fixed, inwardly facing teeth 44 disposed circumferentially around opening 46, which opening is desirably sized to releasably engage hexagonal outer surface 80 of tool 14. Small end 48 has a plurality of fixed, inwardly facing teeth 50 disposed circumferentially around opening 52, which is desirably sized to releasably engage bolts used to secure a valve cover (not shown) to an engine as noted above.

Figure 4:
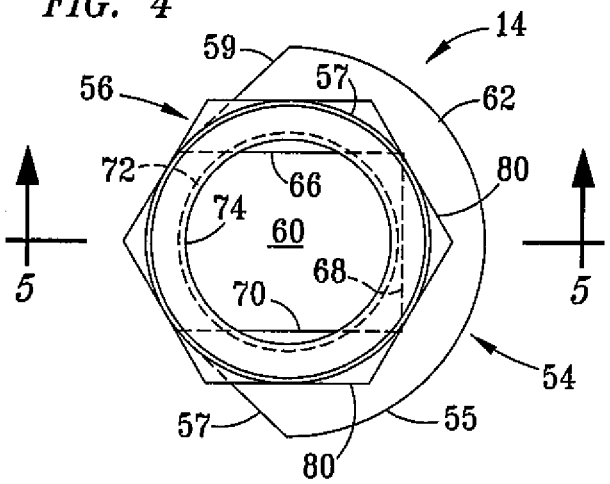
FIG. 4 is a top plan view of the valve bridge adjustment tool of FIG. 1.
Figure 6:
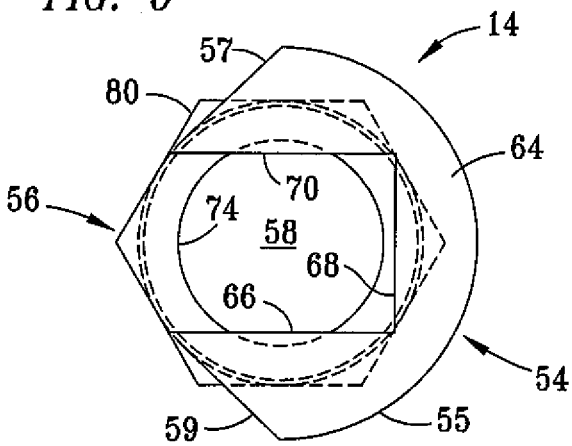
FIG. 6 is a bottom plan view of the valve bridge adjustment tool of FIG. 1.
Figure 10:
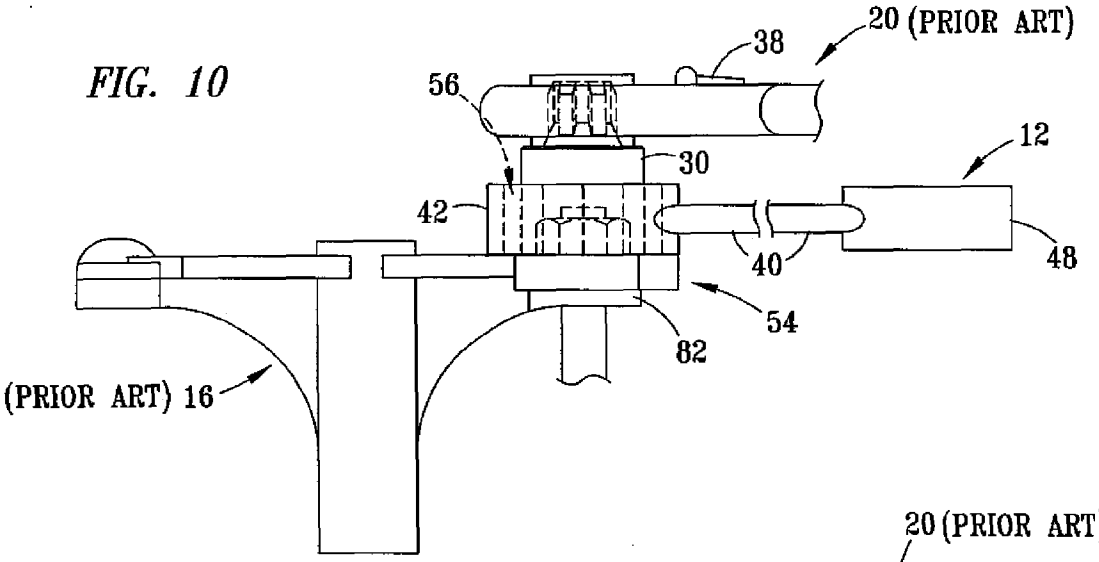
FIG. 10 is a front elevation view of the parts shown in FIG. 1 assembled for use in loosening or tightening a jam nut abutting the top of a valve bridge.

Referring to FIGS. 4-6, lower section 54 of tool 14 desirably further comprises an upwardly facing, arcuately extending top surface 62 and a downwardly facing, arcuately extending bottom surface 64. During use of the invention, which is more completely described in relation to FIGS. 1 and 10, top surface 62 provides a resting surface for end 42 of wrench 12 after opening 46 has been lowered into engagement around hexagonal outer surface 80 of top section 56 of tool 14. Opposite the portion of tool 14 comprising arcuately extending surfaces 62, 64 is a recess 58 in bottom section 54 that is sized and configured to releasably but snugly engage knuckle 82 of bridge 16 as shown in FIG. 10. Referring again to FIGS. 4-6, recess 58 is desirably U-shaped, bounded by rear wall 68 bounded by inwardly facing side walls 66, 70 and having an open end opposite rear wall 68. The open end of recess 58 is further defined by the obliquely angled outside walls 57, 59, respectively that further define laterally opposed jaws providing lateral support to the portions of side walls 66, 70 projecting away from back wall 68.

Upper section 56 of tool 14 desirably further comprises a hexagonal side wall 80 having a generally cylindrical bore 60 that is coaxially aligned with jam nut 28 (FIG. 1) of bridge 16 when bottom section 54 is engaged with knuckle 82. Bore 60 has a bore sufficiently large to receive jam nut 28 upwardly through recess 58 of bottom section 54 and into the bottom portion of bore 60 as tool 14 is lowered into position over bridge 16 from the position shown in FIG. 1 to the position shown in FIG. 10. Referring again to FIGS. 4-6, cylindrical inside wall 74 desirably has a diameter that is also sufficient to receive and accommodate a conventional socket 18 as discussed below in relation to FIGS. 7-9. According to one embodiment of the invention, an annular recess 72 is desirably provided near the top of cylindrical inside wall 74 to receive and accommodate an O-ring or snap ring 75 (FIG. 8) to assist in holding socket 18 snugly inside cylinder 60.

Figure 7:
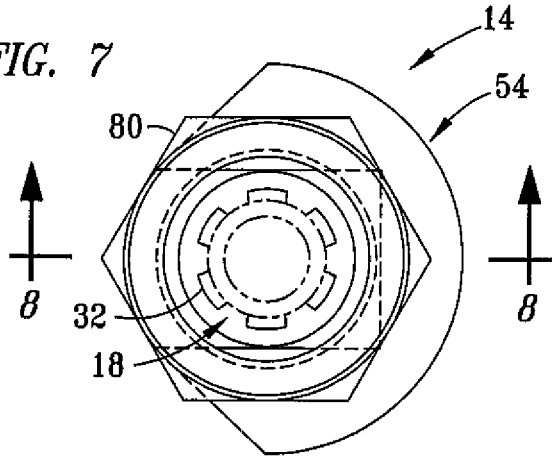
FIG. 7 is a top plan view as in FIG. 1 with a pass-through socket shown in phantom outline and disposed in a use position inside the top section of the socket.
Figure 8:
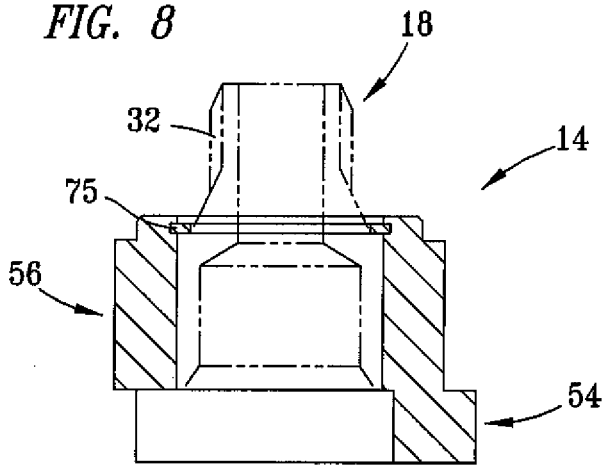
FIG. 8 is a cross-sectional front elevation view taken along line 8-8 of FIG. 7.
Figure 9:
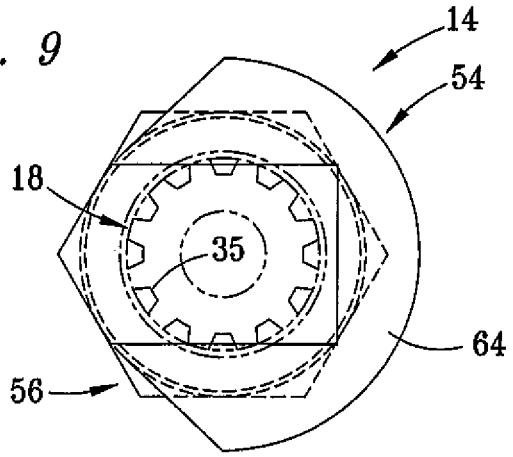
FIG. 9 is a bottom plan view as in FIG. 7 with a socket shown in phantom outline and disposed in a use position inside the top section of the socket.

Referring to FIGS. 7-9, a conventional pass-through socket 18 is shown in phantom outline in the position in which it is desirably inserted into top section 56 of tool 14. FIG. 7 depicts in solid outline the tops of circumferentially spaced splines 32 (also visible in FIG. 8) that can be engaged by a conventional pass-through ratchet wrench having a female receptacle such as wrench 20 shown in FIG. 1. FIG. 9 depicts the inwardly facing, circumferentially spaced teeth 35 disposed inside pass-through socket 18. These are the teeth that desirably engage the corners and outside surfaces of jam nut 28 (FIG. 1) when lower portion 30 of socket 18 is disposed in the position shown in FIG. 10.

Figure 11:
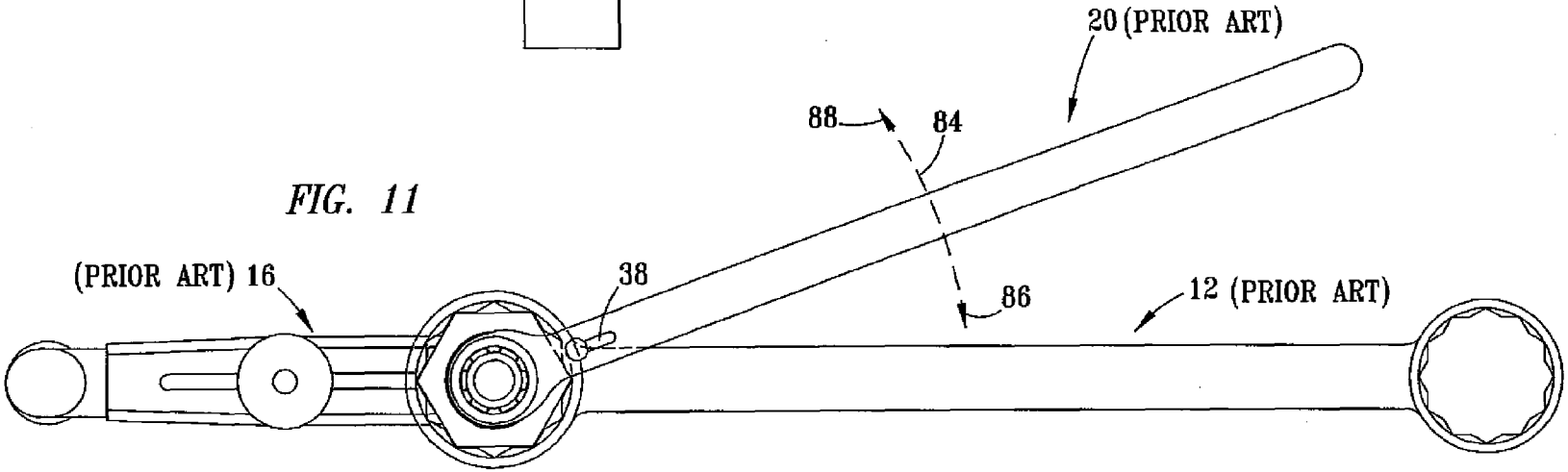
FIG. 11 is a simplified top plan view of the assembly of FIG. 10 to better illustrate the directional movement of the socket wrench relative to the box-end wrench during use of the subject valve bridge adjustment tool to selectively loosen or tighten the jam nut.

Referring to FIG. 10, top section 56 and bottom section 54 of tool 14 (FIG. 1) of the invention are depicted in the use position in juxtaposition to conventional valve bridge 16 and wrenches 12, 20. End 42 of wrench 12 is depicted as resting on bridge 16 and on the back portion of bottom section 54 of tool 14, and pass-through socket 18 (FIG. 1) is engaged with the female ratchet portion of wrench 20. Selector lever 38 is desirably provided for use in reversing the direction in which force is applied during loosening or tightening of jam nut 28 (FIG. 1), respectively. Referring to FIG. 11, arrow 84 depicts the directions in which wrench 20 can be pivoted in relation to wrench 12 and bridge 16 during use. Arrowhead 88 depicts the direction of motion of wrench 20 when loosening jam nut 28 (FIG. 1) on the bridge and arrowhead 86 depicts the motion of wrench 20 when tightening the jam nut (following pivotal repositioning of selector lever 38).

Figure 12:
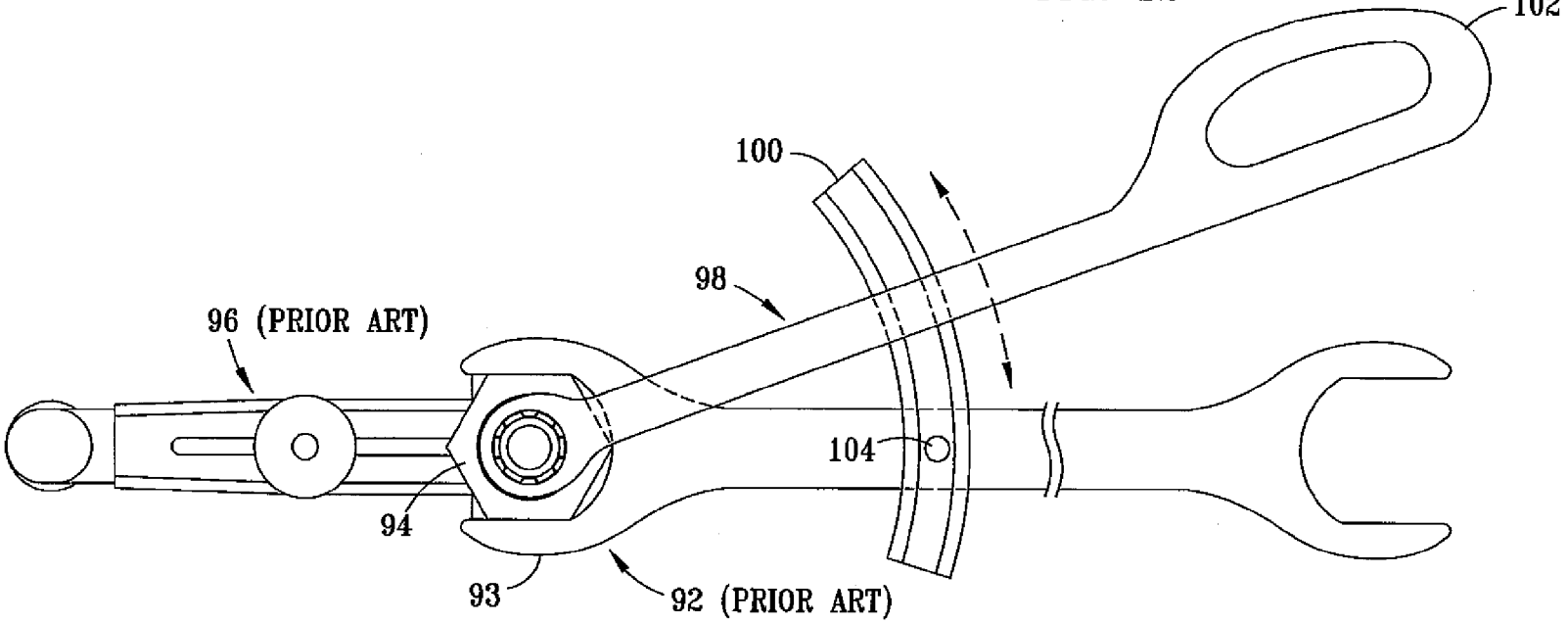
FIG. 12 is a top plan view of another embodiment of the invention disposed in the same position as in FIG. 10.
Figure 13:
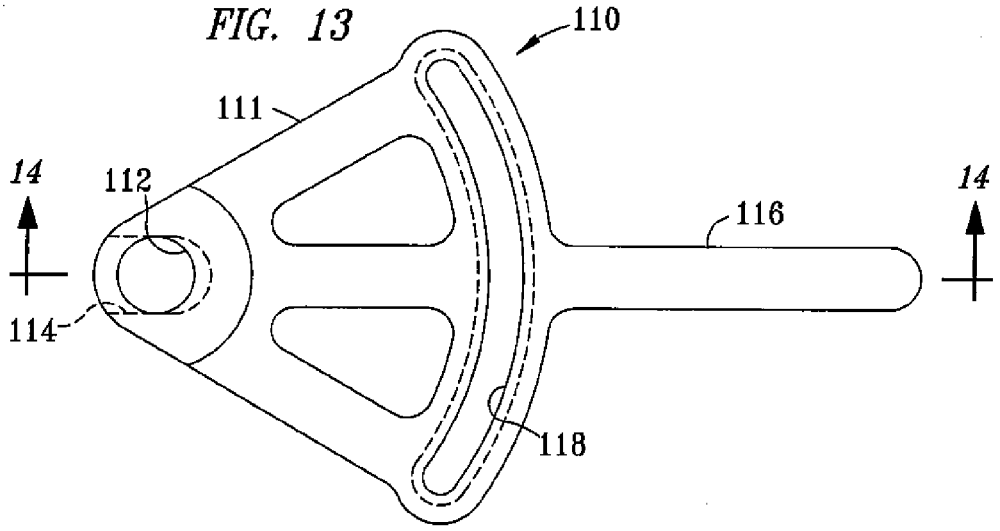
FIG. 13 is a top plan view of yet another embodiment of the invention.
Figure 14:
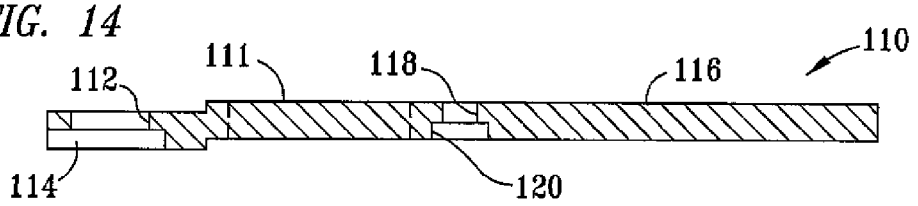
FIG. 14 is a cross-sectional view taken along line 14-14 of FIG. 13.

FIG. 12 depicts another embodiment 90 of the invention in which tool 14 of FIGS. 1, 10 is replaced with wrenches 92, 98 that are interconnected with a track guide 100 that is pinned to wrench 92. FIGS. 13-14 depict another embodiment of the invention wherein wrench 92 is reconfigured as specially adapted wrench 110 having a spread body section 111, an orifice 112 to receive jam nut 28 (FIG. 1) into engagement with an overlying wrench or socket (not shown), and an underlying recess 114 to slidably engage knuckle 82 of bridge 16 (FIG. 1). An arcuate slot 118 with an undercut arcuate channel 120 is desirably provided for use in linking wrench 110 to the overlying tool wrench or socket that engages the jam nut.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventors are legally entitled.

I claim:

1. A valve bridge adjustment tool comprising top and bottom sections disposed in fixed relation to each other, the bottom section further comprising a recess that is releasably engageable with a knuckle of the valve bridge to stabilize the valve bridge during selective loosening or tightening of a jam nut disposed adjacent to a surface of the valve bridge, and the top section further comprising a hexagonal outer wall and a substantially cylindrical bore adapted to receive the jam nut upwardly through the recess into the bottom portion of the bore, the bore providing sufficient clearance around the jam nut to permit insertion of a conventional socket into the top of the bore and into engagement with the jam nut.

2. The valve bridge adjustment tool of claim 1 wherein the recess is U-shaped.

3. The valve bridge adjustment tool of claim 1 wherein the recess has a forwardly facing open end.

4. The valve bridge adjustment tool of claim 1 wherein the cylindrical bore further comprises an annular recess containing a socket retainer ring.

5. The valve bridge adjustment tool of claim 1 made of a durable metal alloy.

6. The valve bridge adjustment tool of claim 5 wherein the alloy is steel.

7. The valve bridge adjustment tool of claim 1 wherein the bottom section further comprises an upwardly facing wrench support surface.

* * * * *